US006708874B1

(12) United States Patent
Montgomery

(10) Patent No.: US 6,708,874 B1
(45) Date of Patent: Mar. 23, 2004

(54) CARTON WITH FINGER HOLES

(75) Inventor: Douglas C. Montgomery, Walden, NY (US)

(73) Assignee: Footstar Corporation, West Nyack, NY (US)

( * ) Notice: Subject to any disclaimer, the term of this patent is extended or adjusted under 35 U.S.C. 154(b) by 0 days.

(21) Appl. No.: 10/155,977

(22) Filed: May 28, 2002

(51) Int. Cl.[7] ..... B65D 5/36; B65D 5/46

(52) U.S. Cl. ..... 229/117.16; 229/125.19; 206/815

(58) Field of Search ..... 229/117.16, 117.09, 229/120, 125.19, 120.09; 206/815

(56) References Cited

U.S. PATENT DOCUMENTS

| | | | | | |
|---|---|---|---|---|---|
| 1,034,878 | A | | 8/1912 | Connolly | |
| 1,758,511 | A | * | 5/1930 | Gross | 229/125.19 |
| 2,041,949 | A | * | 5/1936 | Patterson | 229/120 |
| 2,412,402 | A | * | 12/1946 | Huye | 229/125.26 |
| 2,611,527 | A | | 9/1952 | Fisher | |
| 2,615,613 | A | | 10/1952 | Reeser | |
| 2,647,679 | A | | 8/1953 | Schilling et al. | |
| 2,663,491 | A | | 12/1953 | Hill et al. | |
| 2,736,486 | A | | 2/1956 | Rabby | |
| 2,809,775 | A | | 10/1957 | White | |
| 2,990,995 | A | | 7/1961 | Wessel | |
| 3,018,940 | A | * | 1/1962 | Deline | 229/120 |
| 3,369,728 | A | * | 2/1968 | Royce | 229/120 |
| 3,527,399 | A | | 9/1970 | Layne, Sr. | |
| 3,533,547 | A | | 10/1970 | Houston | |
| 3,536,249 | A | | 10/1970 | Houston | |
| 4,175,691 | A | * | 11/1979 | Cornell et al. | 229/120 |
| 4,206,869 | A | | 6/1980 | Gurevitz | |
| 4,244,508 | A | * | 1/1981 | Schulman | 229/182 |
| 4,383,637 | A | | 5/1983 | Pfieffer et al. | |
| 4,635,843 | A | | 1/1987 | Tomlinson | |
| 4,842,189 | A | | 6/1989 | Czosnyka | |
| 4,958,730 | A | | 9/1990 | Bunten | |
| 5,121,877 | A | * | 6/1992 | Bodary et al. | 229/120 |
| 5,566,878 | A | | 10/1996 | Peiffer et al. | |
| 5,738,239 | A | | 4/1998 | Triglia | |
| 5,794,780 | A | | 8/1998 | Parrella et al. | |

OTHER PUBLICATIONS

Jonson, Corrugated Board Packagin, 1993, pp 189–211.*

* cited by examiner

*Primary Examiner*—Tri M. Mai
(74) *Attorney, Agent, or Firm*—Seyfarth Shaw LLP

(57) ABSTRACT

A carton includes a folded rectangular base and a folded rectangular cover adapted to fit over the base, so that end and side walls of the cover respectively completely overlap end and side walls of the base. Each of the end walls of the cover and the base has apertures formed therethrough at the upper and lower edges thereof, so that when the carton is closed the cover apertures respectively align with the base apertures to form finger or thumb openings to facilitate grasping the carton.

11 Claims, 3 Drawing Sheets

CARTON WITH FINGER HOLES

BACKGROUND

This application relates to containers and, in particular, to box-like cartons which are stackable.

It is known to provide various types of lidded cartons made of cardboard, paperboard and the like. Such cartons are commonly of a substantially rectangular, parallelepiped shape so that they can be easily stacked. For example, shoe boxes are commonly stacked in shoe retailing establishments, one atop the other and with adjacent stacks in abutting side-by-side relationship on shelving or the like. It can sometimes be difficult to grasp such a shoe box to extract it from the middle of a stack, particularly if the shoe box is of the type wherein the side and end walls of the cover or lid extend all the way to the bottom wall of the base, so that there is no lid rim or lip which can be easily grasped.

It is known to provide cartons with the various types of ventilation openings and hand openings to aid in lifting and carrying large cartons. However, these arrangements may not be suitable for a relatively small cartons, such as shoe boxes or the like.

SUMMARY

This application discloses an improved stackable container which avoids disadvantages of prior containers while affording additional structural and operating advantages.

An important aspect is the provision of a stackable container with an access wall normally visible and accessible when stacked, with improved means for grasping the container and removing it from the stack.

Another aspect is the provision of a container of the type set forth with openings disposed at the junctions between the access wall and top and bottom walls.

In connection with the foregoing aspect, a further aspect is the provision of a container of the type set forth, having a base and a cover which overlaps the base, the openings extending through the overlapping portions of the base and cover walls.

A still further aspect is the provision of a foldable carton blank for forming a carton or container of the type set forth.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
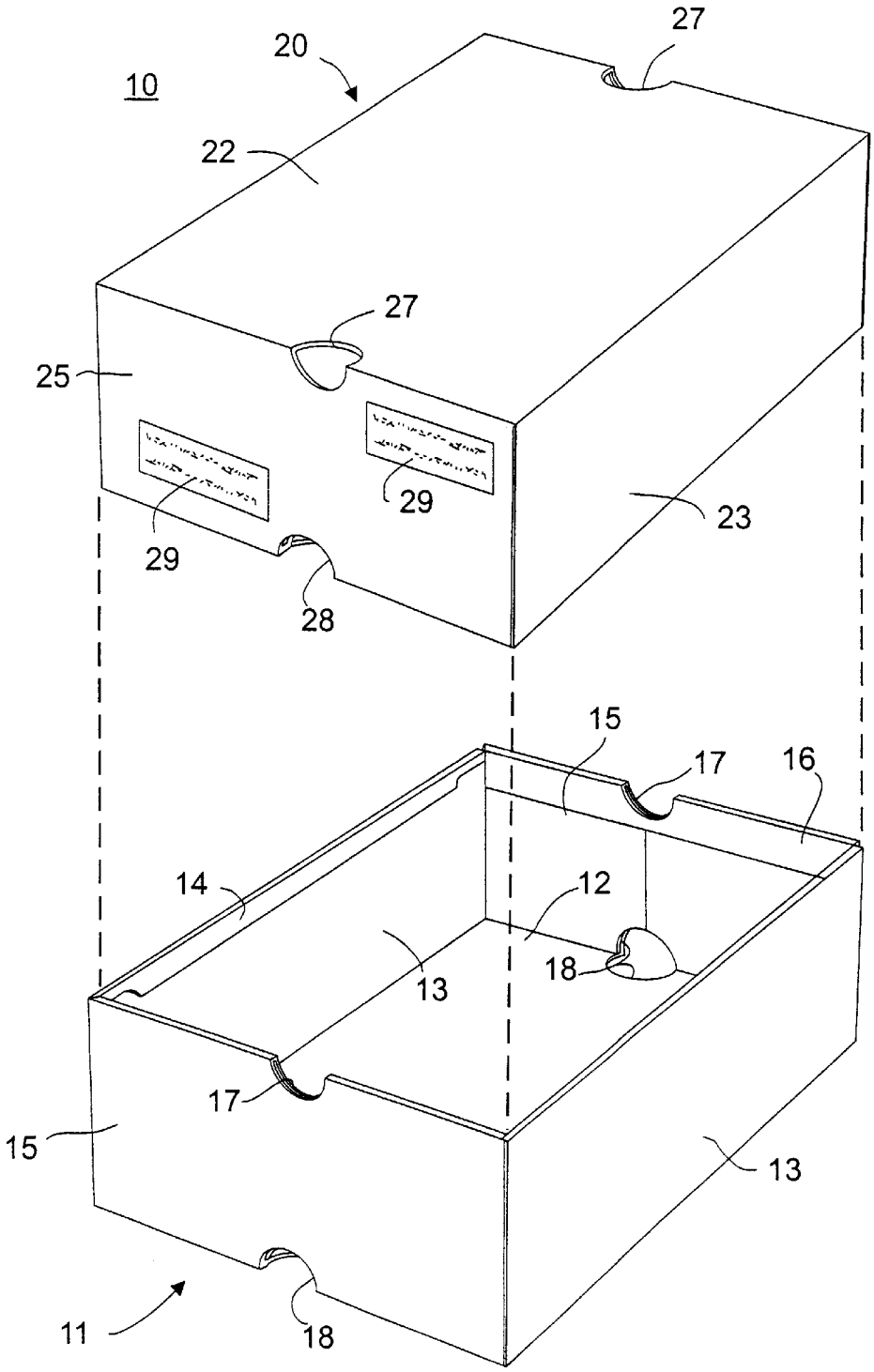
FIG. 1 is an exploded perspective view of a container having a base and a cover with the base and cover shown separated.
Figure 2:
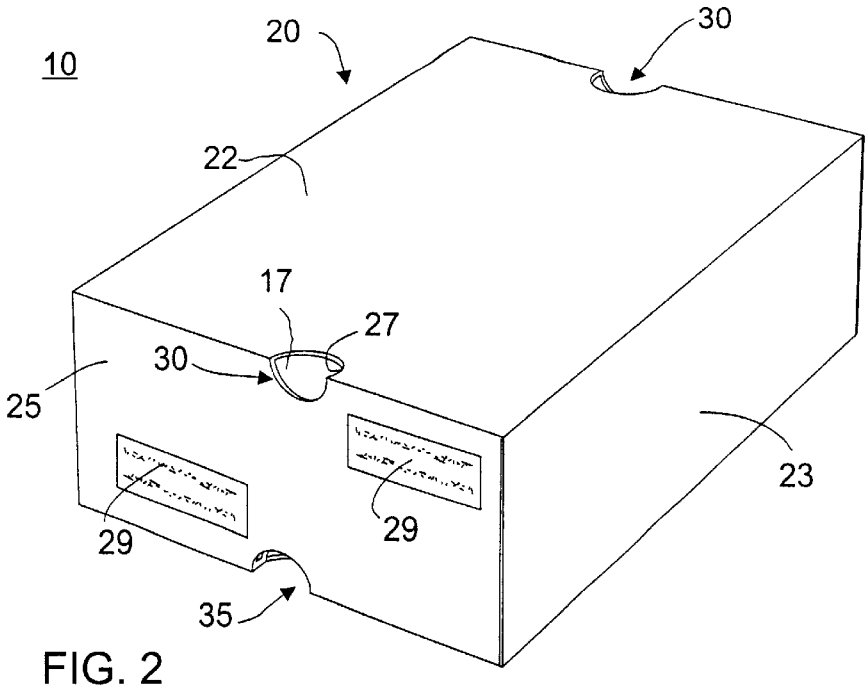
FIG. 2 is a view similar to FIG. 1 showing the container in its closed condition.

Referring to FIGS. 1 and 2, there is illustrated a carton, generally designated by the numeral 10, which has wall structure including a base 11 and a cover 20. The carton may be formed of cardboard, paperboard, or any other suitable material. In the illustrated embodiment, as will explained more fully below, the carton is formed by folding a blank along crease or fold lines, but it will be appreciate that, if desired, it could be formed by other techniques, permitting the use of other types of materials. The base 11 and the cover 20 are similar in shape, each being substantially in the shape of a rectangular parallelepiped, with the cover 20 being slightly larger than the base 11 so that it can receive the base 11 therein, all in a known manner.

The base 11 has a rectangular bottom wall 12 and a pair of upstanding side walls 13 integral with the bottom wall 12 along opposite sides thereof, and each having a folded-over reinforced distal end 14 (one shown in FIG. 1). Also integral with the bottom wall 12, respectively at the opposite ends thereof, are upstanding end walls 15, each being provided with a folded-over reinforced distal end 16 (one shown in FIG. 1). Formed through each of the end walls 15 at the upper edge thereof, midway between the side walls 13, are semi-circular apertures 17. Also formed in each of the end walls 15 at the junction thereof with the bottom wall 12, and in vertical alignment with the associated aperture 17, is an aperture 18, having a semicircular portion in the end wall 15 and a semicircular portion in the bottom wall 12. Thus, the base 11 forms an open-top receptacle defining a storage space therein.

The cover 20 is an open-bottom structure, having a rectangular top wall 22, integral along opposite side edges thereof with depending side walls 23, each having a folded-over reinforced distal end (not shown). Also integral with the top wall 22, respectively at the opposite ends thereof, are depending end walls 25, each having a folded-over reinforced distal end(not shown). Formed in each of the end walls 25 at the junction thereof with the top wall 22, midway between the side walls 23, is an aperture 27 having a semicircular portion formed in the end wall 25 and a semicircular portion formed in the top wall 27. Also formed in each of the end walls 25 at the lower edge thereof, in vertical alignment with the associated aperture 27, is a semicircular aperture 28. Formed on the outer surface of at least one of the end walls 25 may be suitable indicia 29, which could be in the form of labels or be directly imprinted on the material of the end wall 25, and may provide identifying information, such as the nature of the contents of the carton 10, or the like.

Referring to FIG. 2 it can be seen that the cover 20 forms a movable closure portion of the carton 10. The base 11 and the cover 20 are so dimensioned that, when the cover is disposed over the base 11 for closing the carton 10, the base 11 fits within the cover 20, so that the top wall 22 of the cover 20 rests upon the upper edges of the side walls 13 and the end walls 15 of the base 11. In this closed condition, the cover side walls 23 and end walls 25, respectively overlap and completely cover the base side walls 13 and end walls 15. Thus, it can be seen that in this closed condition, the side walls 13 of the base 11 respectively cooperate with the side walls 23 of the cover 20 to form side walls of the overall closed carton, while the base end walls 15 respectively cooperate with a cover end walls 25 to form end walls of the overall carton 10. In this closed condition, the cover apertures 28 respectively align with the portions of the base apertures 18 in the end walls 15, while the base apertures 17 respectively align with the portions of the cover apertures 27 in the end walls 25. Thus, the apertures 17 and 27 cooperate to form through holes 30 at the upper edges of the carton ends, while the apertures 18 and 28 cooperate to form through holes 35 at the lower edges of a carton ends. This greatly facilitates removal of the carton 10 from a stack.

For example, as in the case where the carton 10 is one of a number of shoe boxes stacked one atop the other and with adjacent stacks in abutting side-by-side relationship, the cartons will normally be stacked so that a carton end wall, typically bearing indicia 29, will form an access wall which faces outwardly toward the user. In this regard it will be appreciated that, while indicia have been illustrated on one end wall of the container 10, it could be provided on either or both end walls, as well as on other portions of the carton 10, in a known manner. Preferably, the holes 30 and 35 are dimensioned so as to accommodate insertion therein of a finger or thumb of a user's hand, so that the carton 10 can be easily grasped, as by the use of a thumb and one finger of a hand, to greatly facilitate removing the carton from a stack.

Figure 3:
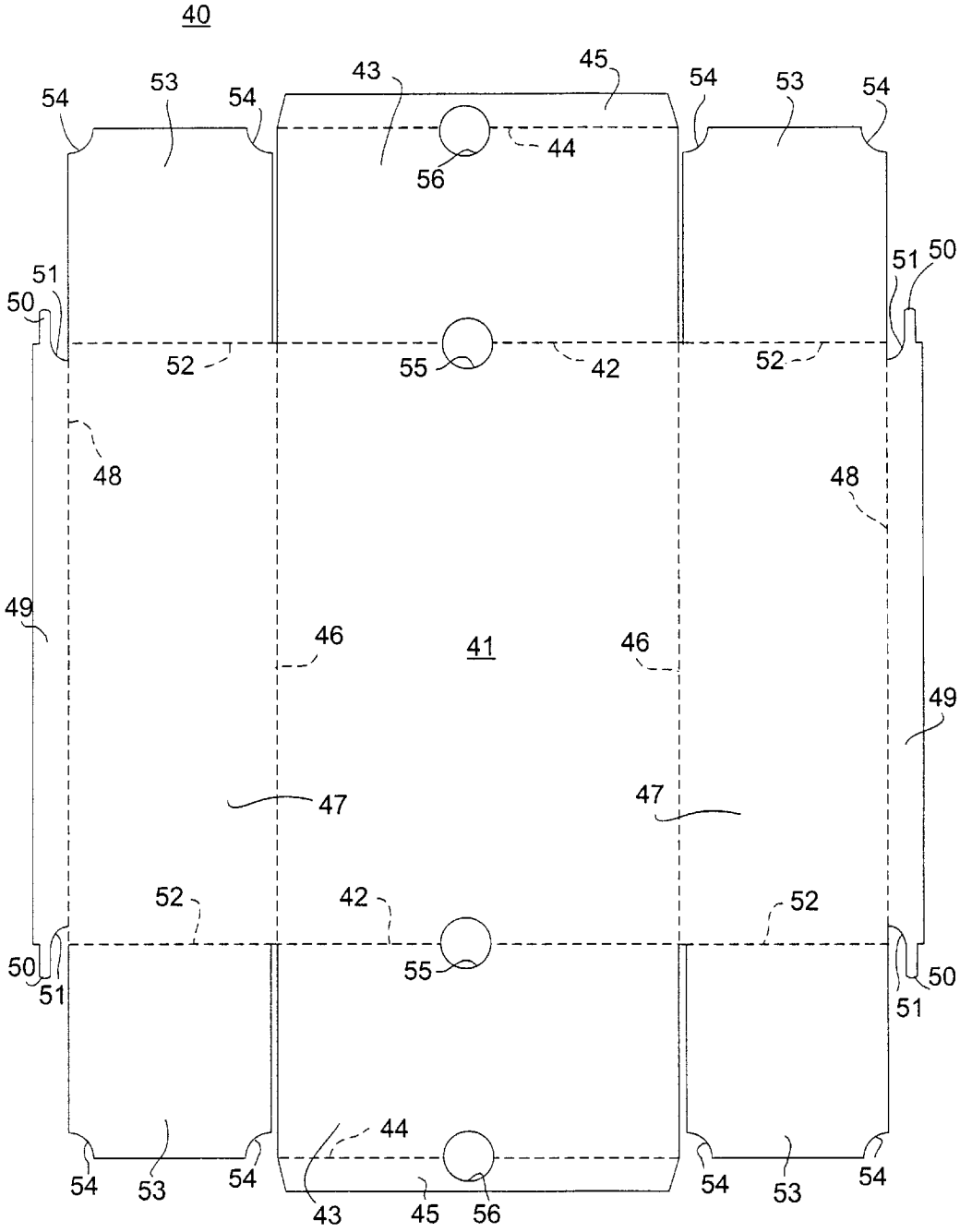
FIG. 3 is a top plan view of a blank for forming either the base or the cover of the carton of FIG. 1.

Illustrated in FIG. 3 is a blank 40 for the formation of the base 11. A similar blank will be used for forming the cover 20, the only difference from the blank 40 being that the cover blank will be slightly larger, as explained above. The blank 40 has a rectangular base panel 41 integral along fold lines 42 with rectangular end panels 43. Each end panel 43 is, in turn, integral along a fold line 44 with a reinforcing flange 45. The base panel 41 is also integral along fold lines 46 with rectangular side panels 47, each, in turn, being integral along a fold line 48 with a reinforcing flange 49. Each flange 49 is provided at the opposite ends thereof with longitudinally outwardly extending lock tabs 50, and is also provided adjacent each tab 50 with an arcuate notch 51 extending to the fold line 48. Each side panel 47 is also integral along fold lines 52 with reinforcement flaps 53 which are substantially rectangular in shape and are each spaced a slight distance from the adjacent end panel 43. Each reinforcement flap 53 has arcuate notches 54 formed at the distal end corners thereof, defining substantially quarter-circles. Formed through the blank 40 are two circular base holes 55, respectively having diameters disposed along the fold lines 42 and each disposed midway between the fold lines 46. Formed through each of the end panels 43 is a circular flange hole 56 having a diameter along the fold line 44 and centered between the lateral edges of the end panel 43. It will be appreciated that the blank 40 may be scored or creased along each of the fold lines to facilitate folding, all in a known manner.

Figure 4:
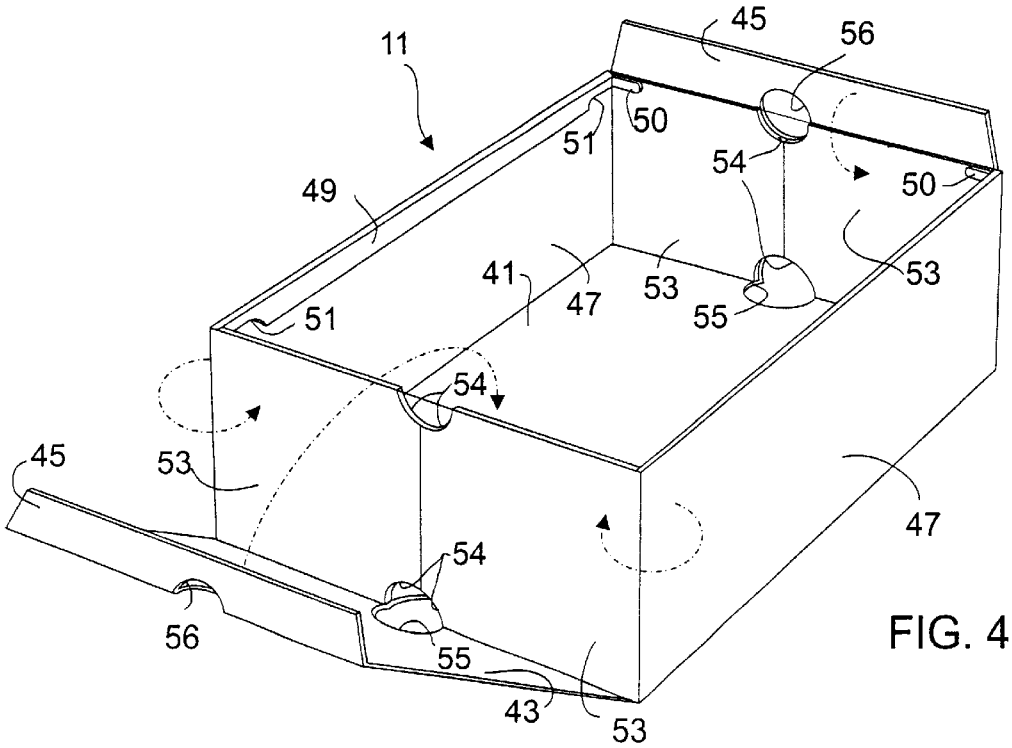
FIG. 4 is a perspective view illustrating folding of the blank of FIG. 3 to form the base of FIG. 1.

Referring to FIG. 4, in assembly, the reinforcing flanges 49 may first be folded over along the fold lines 48 so that they lie along the inner surfaces of the side panels 47, where they may be secured in place, such as by a suitable adhesive to form the reinforced distal ends 14. In this condition, the lock tabs 50 will lie along inner surfaces of the adjacent reinforcement flaps 53. Then the side panels 47 are folded up along the fold lines 46, and the reinforcement flaps 53 are folded along the fold lines 52, so that flaps 53 at the same end of the blank 40 abut each other, as seen in FIG. 4. During this operation the lock tab 50 will be bent accordingly. When in this configuration, the corner notches 54 of abutting reinforcement flaps 53 cooperate to define substantially semicircular apertures. The end panels 43 are then folded up along the fold lines 42 until they lie against the outer surfaces of the reinforcement flaps 53, whereupon the reinforcing flanges 45 may be folded down along the fold lines 44, until they lie along the inner surfaces of the reinforcement flaps 53, trapping the lock tabs 50 therebetween. The reinforcing flanges 45 may then be secured in place in this position, as by a suitable adhesive, to form the reinforced distal ends 16. It can be seen that, when thus assembled, the semicircular apertures formed by the corner notches 54 adjacent to the base panel 41 respectively align with the portions of the base holes 55 formed in the end panels 43, while the semicircular apertures formed by the corner notches 54 at the upper edges of the reinforcement flaps 53 respectively align with the halves of the flange holes 56 which now lie respectively along outer and inner surfaces of the reinforcement flaps 53 to form semicircular through notches.

From the foregoing, it can be seen that there has been provided an improved stackable carton which greatly facilitates removal from a stack of like cartons.

The matter set forth in the foregoing description and accompanying drawings is offered by way of illustration only and not as a limitation. While a particular embodiment has been shown and described, it will be apparent to those skilled in the art that changes and modifications may be made without departing from the broader aspects of applicant's contribution. The actual scope of the protection sought is intended to be defined in the following claims when viewed in their proper perspective based on the prior art.

What is claimed is:

1. A container comprising:

a box-like open-top base having a bottom wall and a pair of short upstanding base end walls and a pair of long upstanding base side walls, each of the base end walls having a first circular aperture therein at an upper edge thereof and a second circular aperture therein at a lower edge thereof and extending into the bottom wall, a box-like open-bottom cover having a top wall and a pair of short depending cover end walls and a pair of long depending cover side walls, each of the cover end walls having a third circular aperture therein at an upper edge thereof and extending into the top wall, each of the cover end walls having a fourth circular aperture therein at a lower edge thereof, the cover being disposable in a closed condition with the cover end walls and cover side walls respectively overlapping the base end walls and base side walls and with the third apertures respectively aligned with the first apertures for cooperation therewith to form first openings, the first openings and the second apertures being dimensioned and positioned to respectively receive simultaneously a finger and a thumb of a user's hand.

2. The container of claim 1, wherein the cover end walls are so dimensioned that in the closed condition of the cover the fourth apertures respectively align with the second apertures to form second openings dimensioned to receive a finger or a thumb of a user's hand.

3. The container of claim 1, wherein each aperture is centered between lateral extremities of its associated end wall.

4. The container of claim 1, wherein the base and the cover are formed of cardboard.

5. The container of claim 1, wherein each of the end walls and side walls has a distal flange folded back over the associated wall to form a reinforced end.

6. A blank for a carton comprising:

a flat rectangular base panel, long side panels respectively joined to opposite sides of the base panel along side fold lines, and short end panels respectively joined to opposite ends of the base panel along end fold lines, each of the end panels including a distal end portion foldable back over the end panel along a flange fold line, first circular holes respectively centered on the end fold lines and second circular holes respectively centered on the flange fold lines, the first and second holes of an end panel being dimensioned and positioned so as to respectively receive simultaneously a finger and a thumb of a user's hand.

7. The blank of claim 6, and further comprising reinforcement flaps respectively joined to opposite ends of each of the side panels along flap fold lines.

8. The blank of claim 7, wherein each of the reinforcement flaps is rectangular in shape and has arcuate notches formed at the free corners thereof, the blank being foldable along the fold lines so that reinforcement flaps of opposed side panels lie along an inner surface of the adjacent end panel with corner notches of one flap cooperating with corner notches of the adjacent flap to form semicircular apertures respectively aligned with corresponding portions of the first and second holes in the associated end panel.

9. The blank of claim 6, wherein each of the side panels includes a distal end flange foldable back over the side panel along a flange fold line.

10. The blank of claim 9, wherein each of the side panel distal end flanges has lock tabs respectively longitudinally extending from opposite ends thereof.

11. The carton of claim 6, wherein each of the holes is centered between lateral extremities of the associated end panel.

* * * * *